US010358801B2

(12) United States Patent
Velapure et al.

(10) Patent No.: US 10,358,801 B2
(45) Date of Patent: Jul. 23, 2019

(54) FREQUENCY MODULATED SPRAYER

(71) Applicant: Kohler Co., Kohler, WI (US)

(72) Inventors: Amruta Shyam Velapure, Sheboygan, WI (US); Fred Ogreenc, Cedar Grove, WI (US); John C. Esche, Kohler, WI (US)

(73) Assignee: KOHLER CO., Kohler, WI (US)

( * ) Notice: Subject to any disclaimer, the term of this patent is extended or adjusted under 35 U.S.C. 154(b) by 62 days.

(21) Appl. No.: 15/662,946

(22) Filed: Jul. 28, 2017

(65) Prior Publication Data

US 2018/0030698 A1 Feb. 1, 2018

Related U.S. Application Data

(60) Provisional application No. 62/369,507, filed on Aug. 1, 2016.

(51) Int. Cl.

| | |
|---|---|
| ***E03C 1/00*** | (2006.01) |
| ***E03C 1/04*** | (2006.01) |
| ***B05B 7/02*** | (2006.01) |
| ***B05B 1/14*** | (2006.01) |
| ***B05B 1/18*** | (2006.01) |
| ***B05B 1/30*** | (2006.01) |
| ***B05B 17/06*** | (2006.01) |
| *B05B 1/00* | (2006.01) |

(52) U.S. Cl.

CPC ..... *E03C 1/0404* (2013.01); *B05B 1/14* (2013.01); *B05B 1/18* (2013.01); *B05B 1/3013* (2013.01); *B05B 7/02* (2013.01); *B05B 17/0607* (2013.01); *B05B 1/00* (2013.01)

(58) Field of Classification Search

CPC ..... B05B 1/002; B05B 17/06; B05B 17/08; E03C 1/0404

USPC ..... 239/16–33

See application file for complete search history.

(56) References Cited

U.S. PATENT DOCUMENTS

| | | | | |
|---|---|---|---|---|
| 2,381,213 A * | 8/1945 | Forman | B05B 3/00 239/229 |
| 2,611,645 A | 3/1948 | Forman | |
| 3,907,204 A | 9/1975 | Przystawik | |
| 4,121,835 A * | 10/1978 | Garabedian | A47G 21/182 138/121 |

(Continued)

FOREIGN PATENT DOCUMENTS

| | | |
|---|---|---|
| CN | 2709025 | 7/2005 |
| CN | 1878620 | 12/2006 |

(Continued)

OTHER PUBLICATIONS

Brusspup, "Amazing Water & Sound Experiment #2", Mar. 11, 2013 (https://www.youtube.com/watch?v=uENITui5_jU), (Year: 2013 ).*

*Primary Examiner* — Viet Le

(74) *Attorney, Agent, or Firm* — Foley & Lardner LLP

(57) ABSTRACT

A sprayer including a fluid carrier having an inlet configured to receive water from a water source and an outlet for emitting water, and including a vibration source coupled to a portion of the fluid carrier between the inlet and the outlet. When the sprayer is in a first mode of operation, water is emitted from the outlet in a first pattern; and when the sprayer is in a second mode of operation, the vibration source is configured to oscillate the fluid carrier such that water is emitted from the outlet in a second pattern.

20 Claims, 8 Drawing Sheets

(56) References Cited

U.S. PATENT DOCUMENTS 4,265,402 A * 5/1981 Tsai ..... F21S 10/005 239/102.1
4,627,326 A * 12/1986 McFarland ..... G10F 1/06 84/94.2
4,936,506 A * 6/1990 Ryan ..... B05B 17/08 239/18
4,955,540 A 9/1990 Fuller et al.
5,524,822 A 6/1996 Simmons
6,053,423 A * 4/2000 Jacobsen ..... B05B 17/08 239/18
6,095,889 A * 8/2000 Demarinis ..... A63H 5/00 239/211
6,527,257 B1 * 3/2003 Schuld ..... B05B 17/085 239/17
6,717,383 B1 * 4/2004 Brunt ..... A01K 63/047 239/18
6,730,051 B2 * 5/2004 Lin ..... A61H 9/0071 15/29
6,768,416 B2 * 7/2004 Petruzzi ..... G10K 1/065 116/141
7,080,916 B1 * 7/2006 Ferrin ..... A47G 19/2227 220/705
7,228,874 B2 * 6/2007 Bolderheij ..... E03C 1/04 137/801
7,302,767 B2 * 12/2007 McKnight ..... B44C 5/00 40/409
7,698,754 B2 * 4/2010 Kunkel ..... B05B 1/044 239/16
8,550,928 B2 * 10/2013 Hamelin ..... A63G 31/007 239/17
8,887,666 B2 * 11/2014 Liu ..... A01K 7/02 119/74
9,242,264 B2 1/2016 Lee
9,278,369 B2 3/2016 Lee et al.
2006/0108437 A1 * 5/2006 Gluck ..... B05B 17/08 239/17
2006/0175424 A1 * 8/2006 Tatum ..... B05B 17/08 239/18
2009/0212123 A1 * 8/2009 Crutcher ..... A63H 3/003 239/25
2010/0276508 A1 * 11/2010 Davies ..... B05B 17/08 239/18
2015/0014431 A1 * 1/2015 Whittaker ..... A47G 21/182 239/33
2015/0231661 A1 * 8/2015 Lee ..... H04R 1/028 239/18

FOREIGN PATENT DOCUMENTS

CN 201094941 8/2008
CN 203979571 12/2014
CN 204201218 3/2015
CN 104799733 7/2015

* cited by examiner

FREQUENCY MODULATED SPRAYER

CROSS-REFERENCE TO RELATED APPLICATIONS

This application claims the benefits of and priority to U.S. Provisional Patent Application No. 62/369,507, filed on Aug. 1, 2016. U.S. Provisional Patent Application No. 62/369,507 is incorporated by reference herein in its entirety.

BACKGROUND

This application relates generally to the field of sprayers for water and other liquids. More specifically, this application relates to a frequency modulated sprayer for water and other liquids.

SUMMARY

At least one embodiment relates to a sprayer that is connectable to a water source for receiving water. The sprayer includes a fluid carrier and a vibration source. The fluid carrier has an inlet that is configured to receive water from the water source and an outlet for emitting water. The vibration source is coupled to a portion of the fluid carrier between the inlet and the outlet. When the sprayer is in a first mode of operation, water is emitted from the outlet in a first pattern; and when the sprayer is in a second mode of operation, the vibration source is configured to oscillate the fluid carrier such that water is emitted from the outlet in a second pattern.

At least one embodiment relates to a sprayer that includes a housing, a fluid carrier, a vibration source, and a controller. The fluid carrier is disposed in the housing and the housing includes an inlet that is configured to receive water and an outlet for emitting water. The vibration source is disposed in the housing and is operable in two or more modes of operation. By way of example, the vibration source may be operable in a first mode of operation, in which the water is emitted from the outlet having a first shape, and in a second mode of operation, in which the vibration source moves the fluid carrier such that the water emitted from the outlet has a second shape that is different than the first shape. The controller is configured to switch the vibration source between the first and second modes of operation.

At least one embodiment relates to a sprayer that includes a body, a water supply tube, and a vibration source. The body has an inlet and an outlet. The water supply tube is configured to extend through the inlet into the body and is moveable relative to the body. The vibration source is operable in two or more modes of operation corresponding to two or modes of the sprayer. For example, the vibration source may be operable in a first mode of operation, in which the tube does not move relative to the body and water is dispensed from the outlet having a first shape, and in a second mode of operation, in which the vibration source moves the water supply tube relative to the body to dispense water from the outlet having a second shape that is different than the first shape.

DETAILED DESCRIPTION

Referring generally to the Figures, disclosed herein are various embodiments of frequency modulated sprayers for water and other liquids for use in faucets (e.g., kitchen faucets, lavatory faucets, laundry faucets), showers (e.g., showerheads, hand-held showers, wall tiles, etc.), side sprays, bidet sprays, whirlpools (e.g., jets), rain panels, toilets (e.g., flush valves, jets/rim holes), washing machines, dishwashing machines, and other suitable kitchen and bath water delivery applications (e.g., plumbing products). The frequency modulated sprayers may be used for other applications, such as, for example, car washers/sprayers, power washers, air blowing devices (e.g., whirlpool, hand/body dryers, etc.), as well as other suitable applications. The frequency modulated sprayers are configured to control the configuration (e.g., shape, flow, etc.) of the emitted fluid (e.g., water, air, liquid, etc.) using an electronically driven vibration source. For example, the vibration source may be configured to change the shape of the fluid stream while the vibration source is active (e.g., operating, activated, etc.), such as from an input shape to an output shape. The input shape and/or the output shape can be, by way of example, linear, curved, wave-form, sinusoidal, helical, spiral, square, step, saw-tooth, or another suitable shape. The input shape and/or the output shape can be a mixture of shapes, such as the shapes identified above or may be a mix of vibrations (e.g., music, audio, etc.). For example, an audio source containing multiple combined and changing waveforms may be utilized as input. The audio source may include music. Further, the output shape does not have to be the same shape as the input signal. For example, a sinusoidal wave input signal may transform the input shape of the fluid source into a helical output shape. The vibration source may be configured to receive a signal (e.g., the input signal), which may be varied (e.g., amplitude, frequency, etc.) to in turn influence/change the shape of the emitted fluid as the signal is varied.

Figure 1:
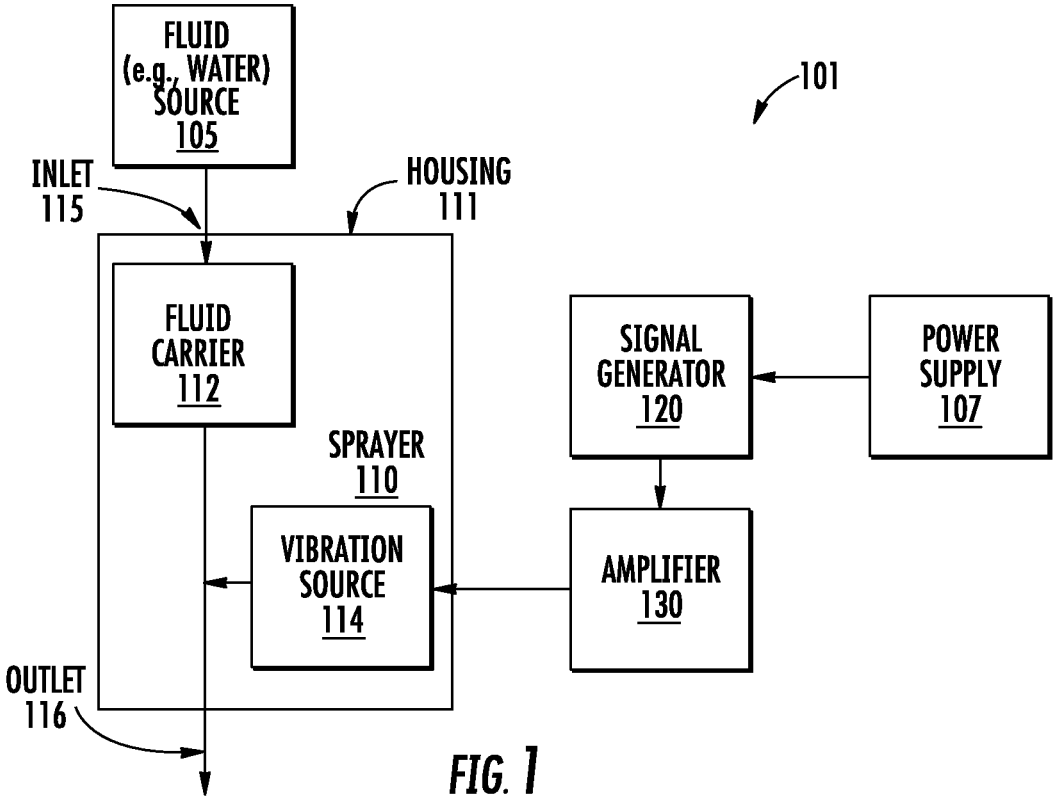
FIG. 1 is a schematic view of an exemplary embodiment of a system containing a frequency modulated sprayer.

FIG. 1 illustrates one non-limiting example of a system 101 (e.g., a faucet assembly, a shower assembly, etc.) including a frequency modulated sprayer 110, a fluid source 105 configured to supply the sprayer 110 with a source of fluid (e.g., water), and a signal generator 120 configured to receive electric power from a power supply 107. As used herein, the term "sprayer" includes, among other devices, faucets, side sprays, bidet sprays, whirlpools, rain panels, toilets, and other suitable kitchen and bath water delivery devices.

The fluid source 105 may be any suitable source to supply the sprayer 110 with a fluid, such as water. The fluid source 105 may be configured to supply the sprayer 110 with a single source of fluid (e.g., a single source of water) or a plurality of sources of fluid, such as, for example, both hot water and cold water.

The power supply 107 is configured to supply electric power (e.g., electrical energy) to the system 101 (e.g., to the signal generator 120, to the sprayer 110, etc.). The power supply 107 can be a fixed power supply (e.g., part of the power grid, such as a 120 V, 60 Hz AC power, etc.) or a local and/or portable power supply (e.g., a battery). It is noted that any type of power supply may be used with the systems as disclosed herein, as the systems may be tailored to operate on any known type of power supply.

The sprayer 110 is configured having a housing 111 (e.g., a body, a casing, an external structure, etc.) that is configured to house (e.g., contain, hold, etc.) other elements/components of the system 101. As shown in FIG. 1, the housing 111 houses a fluid carrier 112 and a vibration source 114. However, the housing 111 may be configured to house other elements/components of the system 101, such as described below for the housing 211 of the sprayer 210.

The fluid carrier 112 is configured to receive fluid (e.g., water) through an inlet 115 (e.g., an opening, an entrance, etc.) and emit (e.g., discharge, spray, etc.) the received fluid from an outlet 116 (e.g., an opening, a nozzle, a sprayhead, etc.). The inlet 115 and the outlet 116 may be part of the fluid carrier 112, part of the housing 111, or part(s) of both. The fluid carrier 112 may be configured as and/or contain a tube, a conduit, or other suitable carrier of fluid. The size (e.g., a length, a cross-section, etc.) of the fluid carrier 112 may be tailored to the specific application of the sprayer 110. The fluid carrier 112 may be flexible in nature (e.g., capable of being moved, manipulated, reconfigured, etc.—such as its shape, location in the sprayer, etc.). A flexible fluid carrier may advantageously provide better response (e.g., more repeatable, broader range of performance, etc.) to manipulation from the vibration source 114. It is noted that the configuration of the fluid carrier 112, such as the size (e.g., larger, smaller), shape (e.g., round, square, custom, etc.), and/or thickness may be tailored to influence the stiffness and/or damping of the fluid carrier and/or system. Thus, these aspects may be tailored to provide unique outputs (e.g., spray patterns), such as during movement (e.g., oscillation) of the fluid carrier 112.

The vibration source 114 is configured to move/vibrate (e.g., oscillate between two or more locations, reciprocate, etc.) the fluid carrier 112 to influence the configuration, such as the shape, of the fluid (e.g., water) emitted from the outlet 116. Accordingly, a portion (e.g., proximate the end having the outlet) of the fluid carrier 112 is operatively coupled to the vibration source 114 to move/vibrate the fluid carrier 112 upon vibration of the vibration source 114. The fluid carrier 112 may be directly coupled to the vibration source 114 or indirectly coupled to the vibration source 114 through another element, such as described in more detail below for the system 301 shown in FIG. 3. The vibration source 114 may be configured as an electroacoustic transducer (e.g., a speaker) that is configured to convert an electrical signal into a corresponding sound by vibrating a diaphragm, such as between two electrically conductive grids. Another example of vibration sources that could be used include, but are not limited to, piezoelectric transducers, which could covert an electric signal into vibrations. However, piezoelectric transducers typically are less responsive at lower frequencies. Other examples of vibration sources may employ mechanical devices, such as motor driven cams. However, mechanical devices may be limited to a fixed pattern. Electrical sources can provide exact and repeatable responses, which can be varied, such as by varying the shape of the electrical input.

The signal generator 120 (e.g., a function generator, a wave generator, etc.) is configured to output a signal, such as a waveform, based on an input, such as electrical power from the power supply 107. The signal generator 120 may be configured to provide a signal that repeats or is non-repeating. The signal may be in the form of a wave having any suitable shape (e.g., sinusoidal, square, etc.). The signal may have a frequency and an amplitude, each of which may be varied (e.g., increased, decreased) by the signal generator 120. Thus, the signal may be a variable signal that is adjustable by a controller, which may be part of the signal generator 120 or a separate element of the system, to change the shape of the variable signal and the shape of the water flow from the outlet 116. It is noted that any suitable signal may be used in the systems of this application, and the flow of fluid emitted may be tailored (e.g., its shape) based on the type of signal generated by the signal generator 120.

The system 101 may optionally include an amplifier 130 (e.g., a signal amplifier) configured to influence the signal from the signal generator 120. For example, the amplifier 130 may be included in the system 101 to increase the power (e.g., amplitude, strength, etc.) of the signal outputted from the signal generator 120. The amplifier 130 may be configured to receive the output signal from the signal generator 120 and in-turn output an expanded signal, such as into the vibration source 114. Thus, the amplifier 130, if provided, may be electrically connected to (e.g., in electric communication with) the signal generator 120 and the vibration source 114. The amplifier 130 may be directly connected to the signal generator 120 and/or the vibration source 114 through electrical lines. The amplifier 130 may be remotely connected to the signal generator 120 and/or the vibration source 114 in a wireless manner. For example, the signal generator 120 may output a radio-frequency (RF) modulated signal (or other suitable wireless signal) that is received remotely by a receiver of the vibration source 114.

As shown in FIG. 1, the fluid carrier 112 and the vibration source 114 are located within the housing 111 of the sprayer 110, while the signal generator 120 and amplifier 130 (if provided) are located external to the housing 111. For example, the fluid carrier 112 may extend through a spout (e.g., of a faucet, a showerhead, etc.) and the vibration source 114 may be located in the spout and connected to a portion of the fluid carrier 112 proximate an outlet (e.g., the outlet 116) in the spout. For this example, the signal generator 120 and the amplifier 130 may be configured to communicate with the vibration source 114 from a remote location relative to the sprayer 110, such as using wireless communication. However, the signal generator 120, the amplifier 130 and/or the power supply 107 may be located within the sprayer 110 (e.g., the housing 111) and/or the device (e.g., the faucet, the showerhead, etc.) that the sprayer is associated with.

Figure 2:
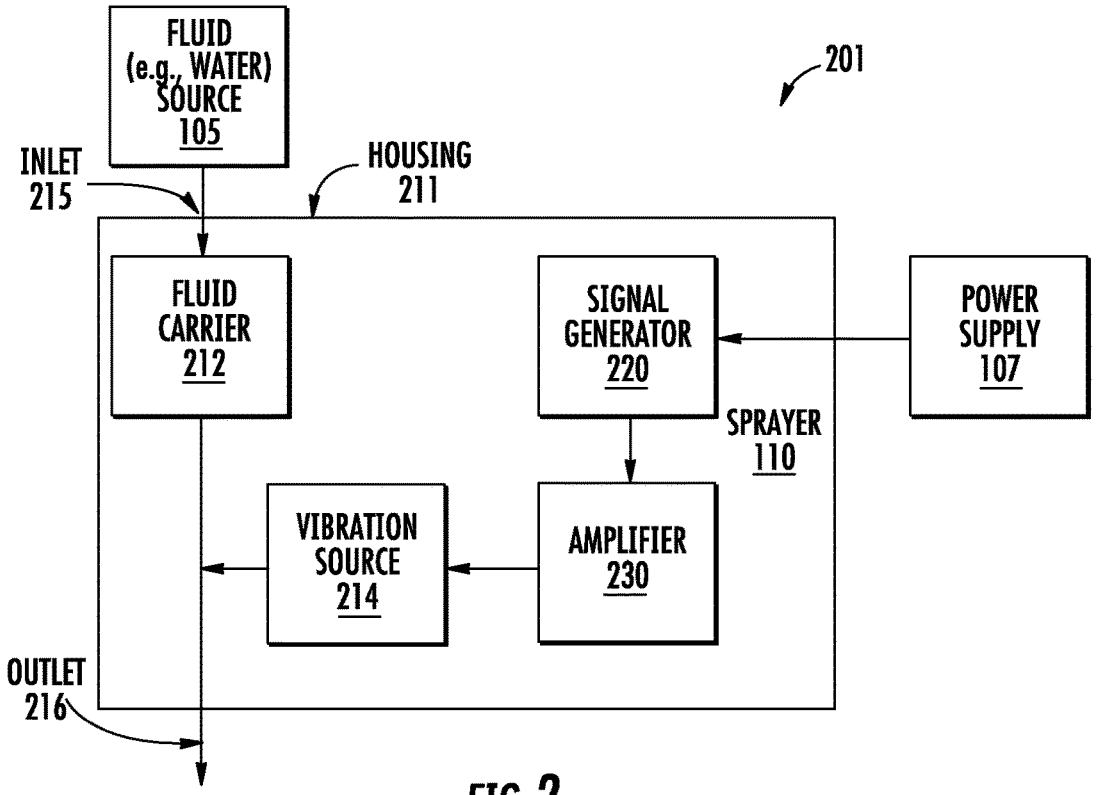
FIG. 2 is another schematic view of another exemplary embodiment of a system containing a frequency modulated sprayer.

FIG. 2 illustrates another non-limiting example of a system 201 containing a frequency modulated sprayer 210. As with the sprayer 110, the sprayer 210 includes a fluid carrier 212 and a vibration source 214 located within a housing 211 of the sprayer 210. As shown, the housing 211 includes an inlet 215, which is configured to receive the fluid (e.g. water) from the fluid source 105, and an outlet 216, which is configured to dispense/emit the fluid having a shape that is influenced by the vibration source 214. The fluid carrier 212 includes an inlet, which may be associated with the inlet 215, and an outlet, which may be associated with the outlet 216.

Unlike the sprayer 110 shown in FIG. 1, the sprayer 210 shown in FIG. 2 further includes the signal generator 220 and the amplifier 230 (if provided) located within the housing 211. Thus, the fluid carrier 212, the vibration source 214, the signal generator 220 and the amplifier 230 (if provided) are all contained within the housing 211 of the sprayer 210. If the sprayer is employed with a faucet, the housing 211 may be part of or include the spout or the spray head, such that all of these elements may be located within the spout or spray head; if the sprayer is employed with a showerhead, similarly, all of these elements may be located within a body of the showerhead; and so forth for other examples of kitchen and bath water delivery applications. The system 201 may advantageously be a single self-contained assembly that is ready for operation upon connecting to the fluid source 105 (e.g., to the inlet 215) and the power supply 107 (e.g., to an electrical connection).

The fluid carrier 212 may be configured the same as the fluid carrier 112, except where noted otherwise. The vibration source 214 may be configured the same as the vibration source 114, except where noted otherwise. The amplifier 230 may be configured the same as the amplifier 130, except where noted otherwise. For example, the amplifier 230 is located within the housing 211 of the sprayer 210 rather than external to the housing 111, as with the amplifier 130. The signal generator 220 may be configured the same as the signal generator 120, except where noted otherwise. For example, the signal generator 220 is located within the housing 211 of the sprayer 210 rather than external to the housing 111, as with the signal generator 120. Accordingly, the housing 211 may have a different size and/or shape to accommodate the additional elements that are housed therein.

Figure 3:
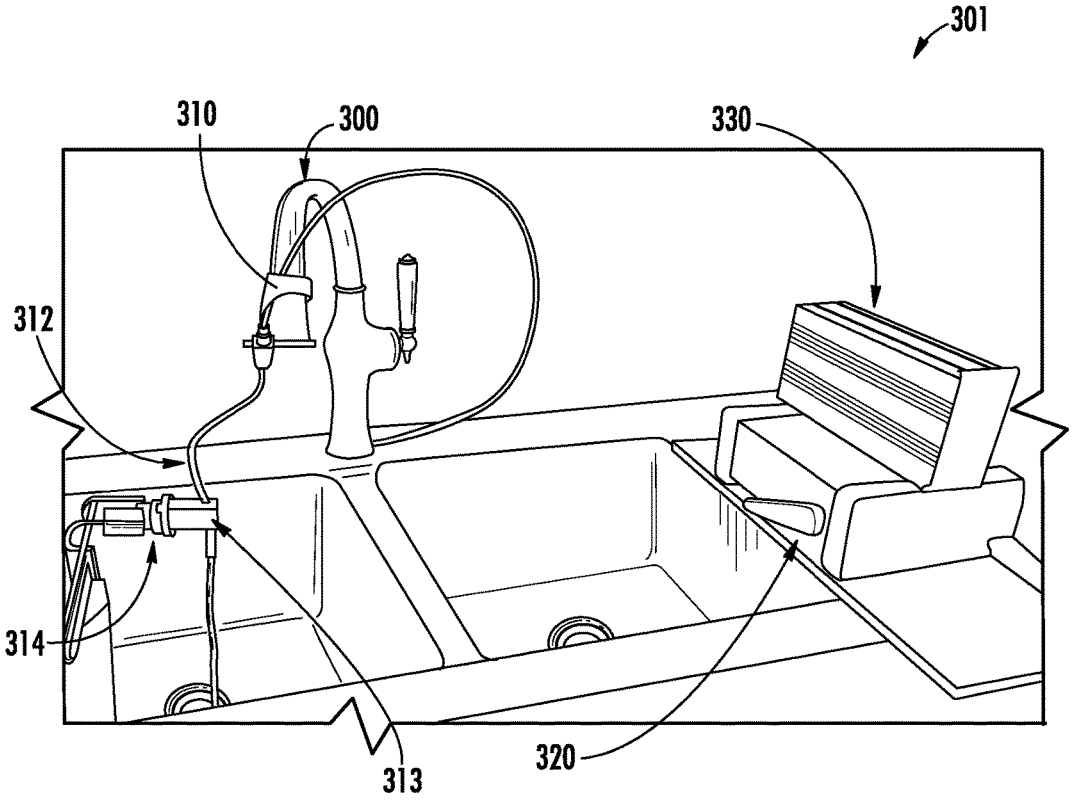
FIG. 3 is a perspective view of another exemplary embodiment of a system containing a frequency modulated sprayer.

FIG. 3 illustrates an example of a mocked up system 301 (e.g., a working test sample) that includes a frequency modulated sprayer 310 employed with a faucet 300. As shown, the system 301 includes a water hose 312, a support 313, a speaker 314, a frequency generator 320, and an amplifier 330. The water hose 312, the support 313 and the speaker 314 are shown external to the sprayer 310 in view of the system being a mocked up test sample. However, it is noted that the water hose 312, support 313, and/or speaker 314 may be contained within a structure, such as the sprayer 310, the sprayer 510, any other sprayer disclosed herein, a body (e.g., housing) of a plumbing fixture (e.g., faucet, showerhead, sprayer, etc.) or some other type of structure. The water hose 312 is configured to receive water at an inlet end and emit water at an outlet end. The support 313 is configured to retain a portion of the water hose 312, such that the portion of the water hose 312 moves with the support when the support 313 is moved by the speaker 314. The support 313 is operatively coupled to the speaker 314, such that vibration from the speaker 314 moves/vibrates the support 313, which in turn moves/vibrates the portion of the water hose 312.

As shown in FIG. 3, the frequency generator 320 and the amplifier 330 are located remotely from the water hose 312 and the speaker 314. As non-limiting examples, the frequency generator 320 and/or amplifier 330 may be remotely located in a wall or other structure, under a sink or other structure (e.g., cabinet), in a remote controller, or other suitable location. It is noted that the amplifier 330 shown in FIG. 3 is optional and may not be necessary in certain embodiments, such as those where the signal output from the frequency generator 320 is of sufficient amplitude.

Figure 4:
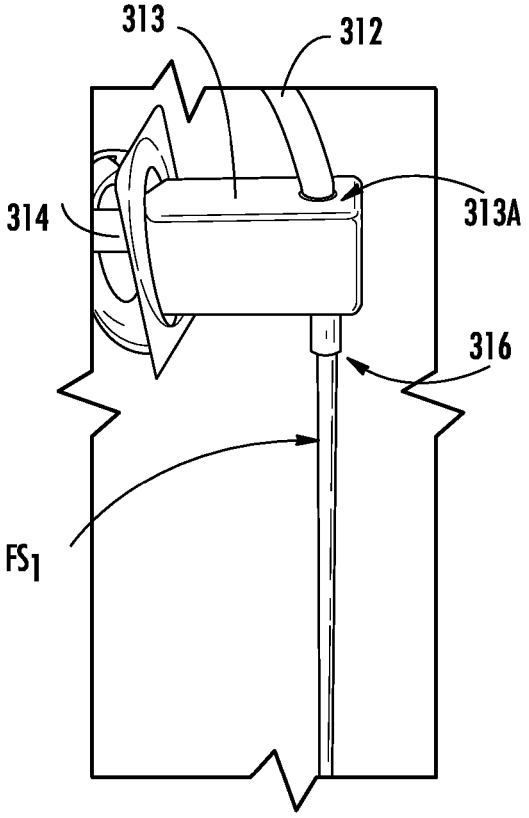
FIG. 4 is a perspective view of a portion of the system shown in FIG. 3 showing water emitted in a first mode of operation.
Figure 5:
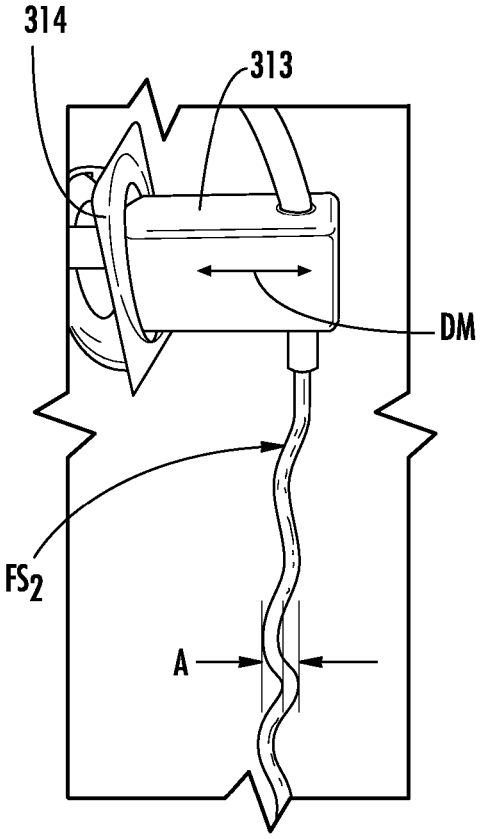
FIG. 5 is another perspective view of the portion of the system shown in FIG. 3 showing water emitted in a second mode of operation.

FIGS. 4 and 5 illustrate the system 301 (or portions thereof) in different modes of operation (e.g., function). FIG. 4 shows water being emitted in a first mode of operation (e.g., of the sprayer 310), and FIG. 5 shows water being emitted in a second mode of operation. The first mode of operation may correspond to a non-excited (e.g., non-moving, non-vibrating, etc.) mode in which no signal is passed into the vibration source (e.g., the speaker 314) and, hence, the support 313 remains stationary, such as relative to a housing of the sprayer 310. The fluid stream $FS_1$ (e.g., water flow) from the outlet 316 is shown in FIG. 4 in the first mode of operation having a first shape that is substantially linear (e.g., like from a traditional faucet). The second mode of operation may correspond to an excited mode in which a signal is passed into the vibration source (e.g., from the signal generator and/or the amplifier) to move/vibrate the vibration source, which in turn moves/vibrates the support 313 coupled to the vibration source. The fluid stream $FS_2$ from the outlet 316 is shown in FIG. 5 in the second mode of operation having a second shape, which is shown as having a substantially sinusoidal shape.

The system 301 may be configured to provide more than two different modes of operation. For example, the sprayer 310 may be configured to provide a third mode of operation, in which the water is emitted from the outlet having a third shape that is different than the first and second shapes discussed above. The third shape may be substantially sinusoidal with a different frequency and/or different amplitude or may be a wholly different shape (e.g., square wave, sawtooth, etc.). For example, an amplified signal (of the signal defining the second mode of operation) may produce a fluid stream having a shape that is different than the second shape.

The vibration source (e.g., the speaker 314) may be configured to move the support 313 in one or more degrees of freedom. As shown in FIG. 5, the system 301 is a single degree of freedom system, such that the vibration source moves (e.g., translates, reciprocates, oscillates, etc.) the support back and forth in a direction of motion DM indicated by the arrow between a minimum position and a maximum position to change the shape of the fluid stream $FS_2$. For example, the fluid stream $FS_2$ may take a waveform shape based on a waveform signal passing through the vibration source. The minimum and maximum positions may be varied (such as by the amplifier 330) to increase/decrease the amplitude A of the fluid stream $FS_2$ (see FIG. 5). It is noted that the system 301 (or any other system disclosed herein) may be configured having more degrees of freedom to further alter the shape of the fluid stream and the example shown in FIG. 5 is not limiting. By way of example, multiple vibration sources can be used to move the fluid stream in more than one degrees of freedom. For example, two vibration sources arranged transverse to one another (e.g., perpendicular to each other), so that a first signal from the first vibration source is transverse (e.g., orthogonal) to a second signal from the second vibration source are able to move the fluid stream (e.g., fluid stream $FS_2$) in the X-direction and/or the Y-direction.

Figure 6:
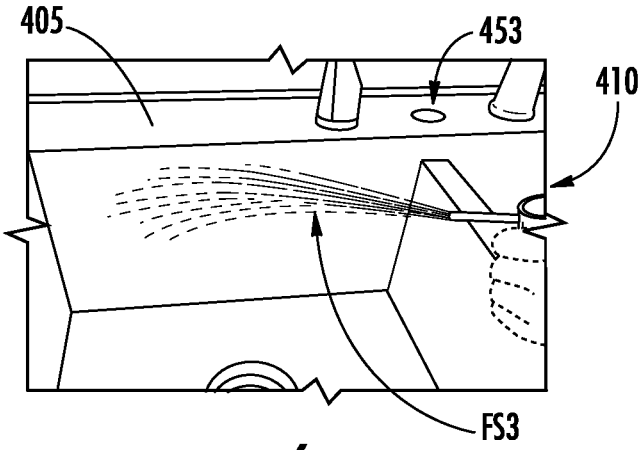
FIG. 6 is a perspective view of another exemplary embodiment of a frequency modulated sprayer configured to mount to a sink.
Figure 7:
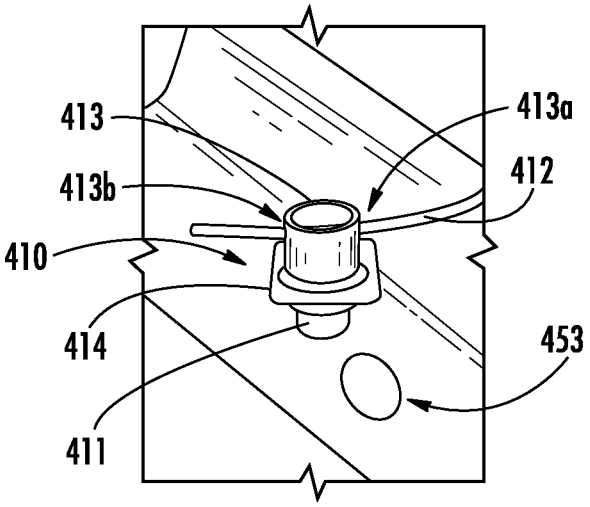
FIG. 7 is another perspective view of the frequency modulated sprayer shown in FIG. 6.

FIGS. 6 and 7 illustrate another exemplary embodiment of a sprayer 410 configured for use with a kitchen sink 405.

For example, the sprayer 410 may be mounted (e.g., moveably, rotatably, fixedly, detachably etc.) to the kitchen sink, such as a deck/rim 451, a divider 452 or another element/feature of the sink 405. The sprayer 410 can be configured to direct the fluid stream in any direction relative to the sink 405 or other device used with the sprayer 410. Further, the sprayer 410 may be used with other applications (e.g., showerheads, inside showers, wall mounted near water inlets, inside sprayers, proximate a base of a sprayer, within spouts or spout tubes such as faucets, lavatories, baths, etc.) and is not limited to use with kitchen sinks. The sink 405 (or other device for other applications) may include an aperture 453 configured to receive a portion of the sprayer 410, such as a base 411, a retainer 413, or another part of sprayer 410.

As shown in FIG. 7, disposed on the base 411 of the sprayer 410 is a vibration source 414 configured to induce vibration when receiving an electric signal, such as from a signal generator and/or an amplifier. Coupled to and extending from a side of the vibration source 414 opposite the base is the retainer 413, which is configured to retain a water hose 412 so that movement induced by the vibration source 414 moves the water hose 412 through the retainer 413. As shown, the retainer 413 has a generally cylindrical shape (e.g., a tube, tubular shaped, etc.) with two openings 413*a*, 413*b* radially aligned (e.g., transverse to a centerline of the tube) for receiving the water hose 412 therein. The openings 413*a*, 413*b* in the retainer 413 may be sized relative to the water hose 412 to secure (e.g., retain) the water hose 412 to the retainer 413 without the use of additional elements/features. The vibration source 414 may be configured to vibrate the water hose 412 through the retainer 413 when the vibration source 414 is excited. The sprayer 410 may include a housing that houses one or more of the other elements of the sprayer 410 and/or portions thereof (e.g., the base 411, the water hose 412, the retainer 413, etc.).

Figure 8:
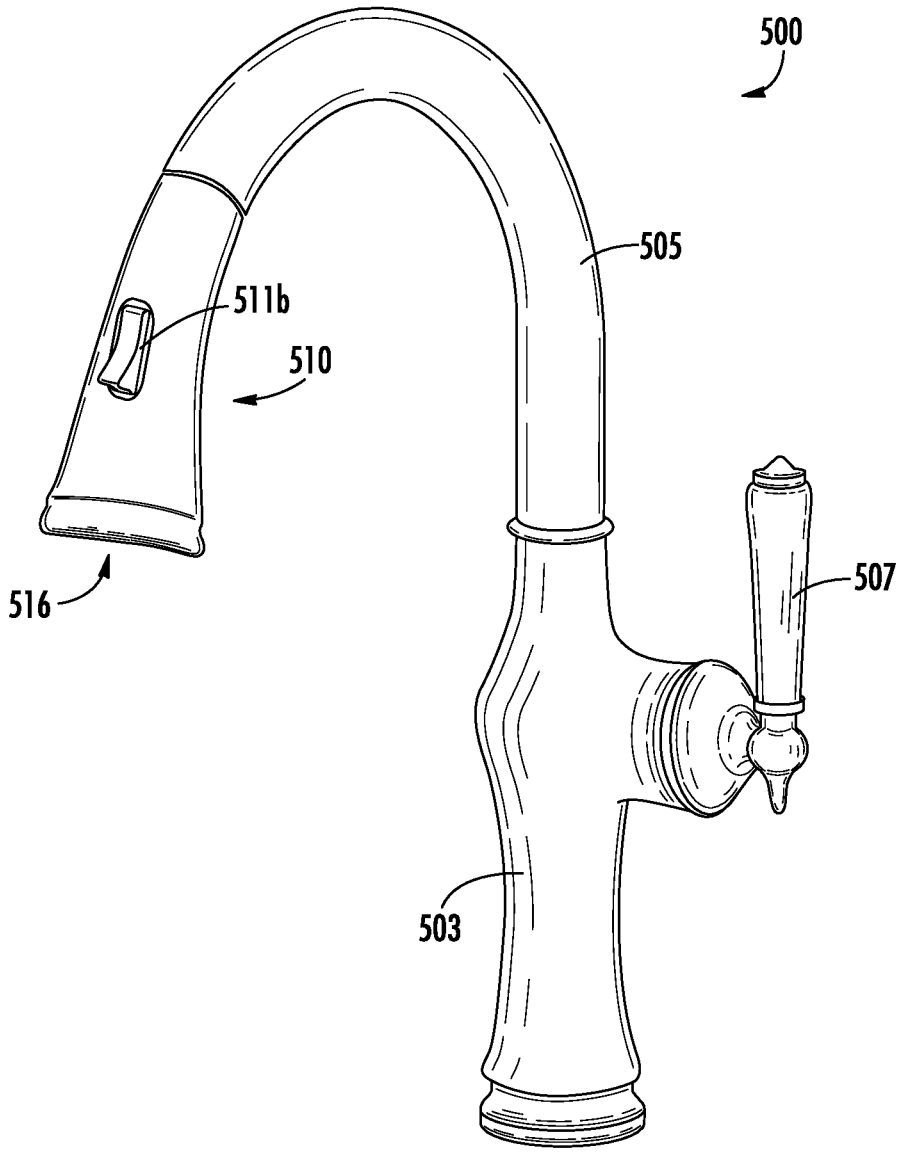
FIG. 8 is a perspective view of a faucet having a frequency modulated sprayer.

FIG. 8 illustrates a faucet 500 that includes a frequency modulated sprayer 510. As shown, the faucet 500 also includes a base 503, a spout 505 and a handle 507. The base 503 is mountable to another object, such as a support, a sink, etc. The spout 505 is coupled (e.g., rotatably coupled, fixedly coupled, etc.) to the base 503. The handle 507 is configured to control fluid flow through the faucet 500, such as a flow rate of a fluid (e.g., water) and/or a temperature of the fluid.

The sprayer 510 is coupled to the spout 505. For example, the sprayer 510 may be detachably coupled to an end of the spout 505 to allow a user to move the sprayer 510 relative to the spout 505 to change the spraying direction of the sprayer 510. As shown in FIG. 8, the sprayer 510 includes an actuator 511*b* that is configured to switch the sprayer 510 between modes of operation (e.g., first mode, second mode, etc.).

Figure 9:
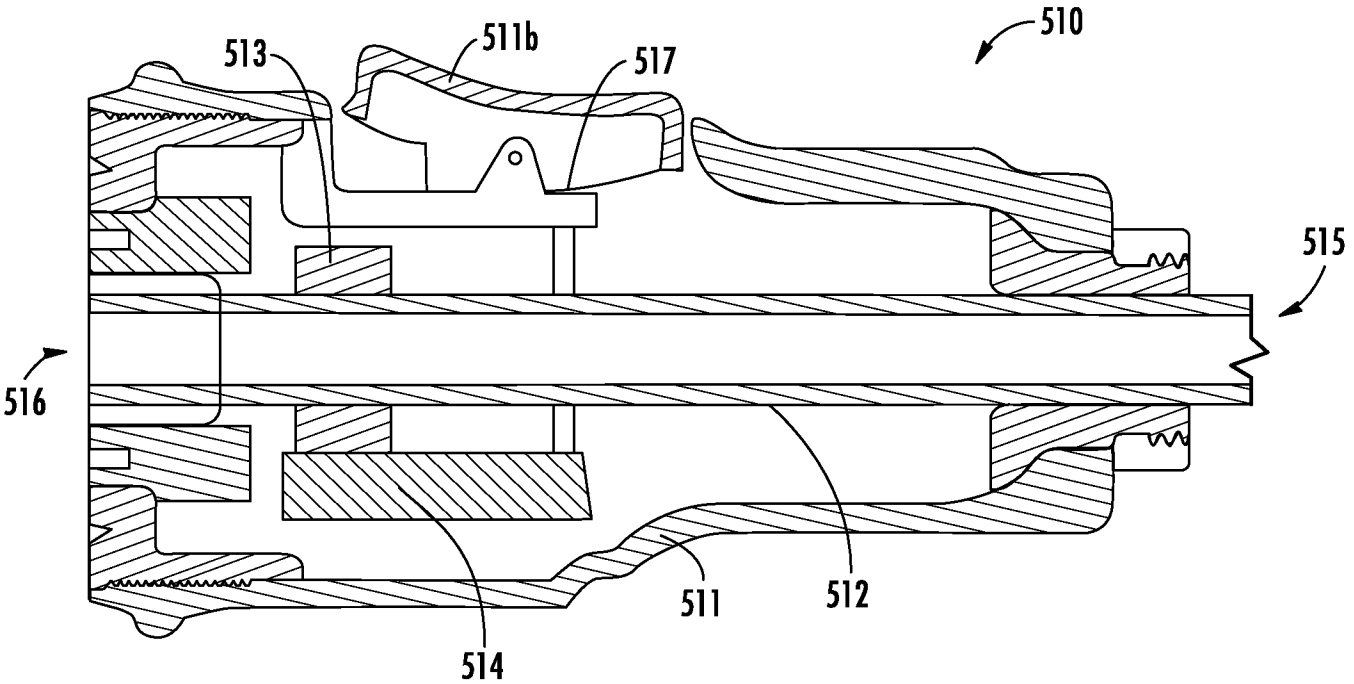
FIG. 9 is a cross-sectional view of the frequency modulated sprayer shown in FIG. 8.

FIG. 9 illustrates the sprayer 510 in cross-section. The sprayer 510 includes a housing 511, a water tube 512 (e.g., fluid conduit, hose, etc.), a support 513 provided in the housing 511, and a vibration source 514 (e.g., a speaker) provided in the housing 511. An actuator 511*b* is operatively coupled to the housing 511 and is configured to control operation of the sprayer 510. The water tube 512 extends between an inlet 515 and an outlet 516. The water tube 512 is fluidly connected to a fluid source and may pass through, for example, the spout 505 and the base 503 of the faucet 500 to fluidly connect to a water source. The support 513 is operatively coupled to portion of the water tube 512 between the inlet 515 and the outlet 516, such that the vibration source 514 is configured to move (e.g., oscillate, reciprocate, etc.) the portion of the water tube 512 through the support 513 in an activated (e.g., excited, on, etc.) mode (e.g., position, etc.).

Figure 10:
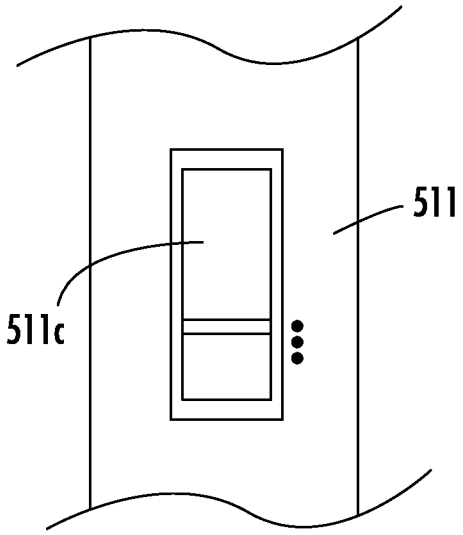
FIG. 10 is an actuator for a frequency modulated sprayer.
Figure 11:
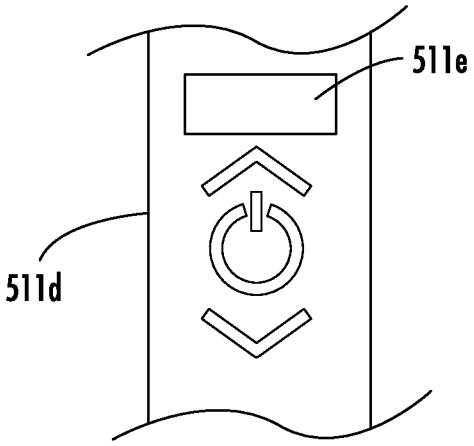
FIG. 11 is a touch sensitive controller for controlling a frequency modulated sprayer.

A controller (e.g., an actuator, a user interface, etc.) may be provided to switch the system/sprayer/vibration source between the different modes of operation (e.g., first mode, second mode, third mode, etc.), such as by a user input into the controller. As shown in FIG. 8, the controller includes the actuator 511*b* that is configured to toggle between two or more positions associated with a respective number of modes of operation of the sprayer 510. The toggling of the actuator 511*b* may switch between the various modes of operation manually, such as by moving a lever connected to another element (e.g., the vibration source 514), or automatically, such as through an electronic device (e.g., a circuit). The controller may include electronics, such as a switch 517 (as shown in FIG. 9) that switches between the modes of operation of the sprayer 510 in response to the actuator 511*b* position. For example, the sprayer 510 may operate in a first mode upon the switch 517 detecting the actuator 511*b* being in the first position (e.g., open switch position), and the sprayer 510 may operate in a second mode upon the switch 517 detecting the actuator 511*b* being in a second position (e.g., closed switch position). As shown in FIG. 10, the controller may include a slide switch 511*c* that moves (e.g., slides) relative to the housing 511 between multiple (e.g., first, second, third, etc.) positions that correspond to multiple modes of operation of the sprayer 510. The slide switch 511*c* may be configured to control, for example, the mode of operation of the vibration source 514 manually and/or electronically to control the mode of operation of the sprayer 510. As shown in FIG. 11, the controller may include a touch sensitive panel 511*d* (e.g., a touchscreen), such as to allow a user to change the mode of operation of the sprayer 510 and/or the functionality of one or more modes of operation based on input into the touch sensitive panel 511*d*. As shown, the panel 511*d* may include an on/off selector, mode(s) of operation selectors, as well as other suitable selectors. The sprayer 510 (e.g., the panel 511*d*) may include a visual display 511*e* that displays the operating settings (e.g., mode of operation) as well as other information regarding the sprayer 510.

The sprayers disclosed in this application may further include one or more light sources or may be used with a device having one or more light sources. The sprayers may be configured using the one or more light sources so that the frequency at which the fluid source vibrates and forms the output shape (e.g., a helical shape) of the fluid stream is high enough (e.g., above a threshold) not to be identifiable with the naked eye. For example, an output helical shape of a stream of a sprayer may be oscillated at or above a threshold frequency such that the helical shape cannot be identified with the naked eyes. Accordingly, a strobe light may be employed having a frequency that generally matches the input signal frequency. This may enable an observer to see a spiral shape of fluid with only the naked eye.

It is noted that other exemplary embodiments of the sprayers and/or systems may be employed and those examples shown and described herein are not meant to be limiting in nature. The systems employing the frequency modulated sprayers may advantageously utilize electrical signals to control the fluid flow (e.g., the shape of the emitted water stream) without having to employ large mechanical elements/assemblies.

At least one embodiment of this application relates to a sprayer that is connectable to a water source for receiving water. The sprayer includes a fluid carrier and a vibration source. The fluid carrier has an inlet that is configured to receive water from the water source and an outlet for emitting water. The vibration source is coupled to a portion of the fluid carrier between the inlet and the outlet. When the sprayer is in a first mode of operation, water is emitted from the outlet in a first pattern; and when the sprayer is in a second mode of operation, the vibration source is configured to oscillate the fluid carrier such that water is emitted from the outlet in a second pattern.

The sprayer may include a signal generator that is configured to produce a signal that oscillates the vibration source. The signal may be configured to oscillate the vibration source between the first position and the second position, such as to influence the shape of water emitted from the outlet of the sprayer. The signal may be a waveform. For example, the waveform may be one of a sinusoidal wave, a square wave, a step wave, and a sawtooth wave. The signal generator may be configured to produce an audio signal that moves the vibration source. The audio signal may be music. The sprayer may include an amplifier that is configured to receive the signal from the signal generator and is configured to output an amplified signal that is received by the vibration source.

The sprayer may include a housing, which houses another element of the sprayer. For example, the fluid carrier and/or the vibration source may be located within the housing. The signal generator and/or the amplifier may also be located in the housing.

At least one embodiment of this application relates to a sprayer that includes a housing, a fluid carrier, a vibration source, and a controller. The fluid carrier is disposed in the housing and the housing includes an inlet that is configured to receive water and an outlet for emitting water. The vibration source is disposed in the housing and is operable in two or more modes of operation. By way of example, the vibration source may be operable in a first mode of operation, in which the water is emitted from the outlet having a first shape, and in a second mode of operation, in which the vibration source moves the fluid carrier such that the water emitted from the outlet has a second shape that is different than the first shape. The controller is configured to switch the vibration source between the first and second modes of operation.

The sprayer may include a signal generator that produces a signal from input power. The sprayer may include an amplifier that receives the signal from the signal generator and outputs an amplified signal to the vibration source in the second mode of operation to oscillate the fluid carrier. The controller may be configured to control operation of the signal generator and the amplifier. Each of the signal generator, the amplifier, and the controller is located in or on the housing.

The sprayer/vibration source may be operable in additional modes of operation, such as a third mode of operation, in which the water is emitted from the outlet having a third shape that is different than the first and second shapes, and the controller switches the vibration source between the first, second, and third modes of operation by a user input into the controller. The amplified signal may have a shape that is different than the second shape.

At least one embodiment of this application relates to a sprayer that includes a body, a tube, and a vibration source. The body has an inlet that is configured to receive water and an outlet that is configured to dispense the water from the body. The tube is located in the body and is moveable relative to the body; and the tube is fluidly connected to the inlet (e.g., at a first end) and to the outlet (e.g., at a second end). The vibration source is operable two or more modes of operation. For example, the vibration source may be operable in a first mode of operation, in which the tube does not move relative to the body and water is dispensed from the outlet having a first shape, and in a second mode of operation, in which the vibration source moves the tube relative to the body to dispense water from the outlet having a second shape that is different than the first shape The sprayer may include a signal generator that produces a signal, wherein the vibration source moves the tube in response to the signal from the signal generator. The signal produced by the signal generator may be a variable signal that is adjustable by a controller to change the shape of the variable signal and the second shape.

A faucet may include a sprayer, as disclosed herein, such as, for example, operatively coupled to a spout of the faucet.

A showerhead may include a sprayer, as disclosed herein, such as, for example, as a fixed showerhead or a removable handset showerhead.

The sprayers, as disclosed herein, may be employed in other types of devices.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the systems/frequency modulated sprayers as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element (e.g., fluid carrier, vibration source, housing, signal generator, amplifier, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A sprayer comprising:

a housing having a hollow body extending from an inlet end to an outlet end;

fluid carrier extending within the hollow body from the inlet end to the outlet end, the fluid carrier being configured to receive water from a water source and emit water through the outlet end;

an actuator coupled to the housing; and a vibration source located within the hollow body and coupled to a portion of the fluid carrier between the inlet end and the outlet end;

wherein water is emitted from the outlet end in a first pattern in a first mode of operation in response to the actuator being in a first position; and wherein the vibration source is configured to oscillate the fluid carrier such that water is emitted from the outlet end in a second pattern in a second mode of operation in response to the actuator being in a second position.

2. The sprayer of claim 1, further comprising a signal generator configured to produce a signal that oscillates the vibration source.

3. The sprayer of claim 2, further comprising an amplifier that receives the signal from the signal generator and outputs an amplified signal that is received by the vibration source.

4. The sprayer of claim 3, further comprising a switch on or in the hollow body of the housing, wherein the switch controls the vibration source in response to the actuator position.

5. The sprayer of claim 4, wherein the signal generator and the amplifier are also housed in the housing.

6. The sprayer of claim 1, wherein the vibration source is configured to oscillate the fluid carrier between a first position and a second position to produce the second pattern of water emitted from the outlet.

7. The sprayer of claim 6, further comprising a signal generator configured to produce a signal that oscillates the vibration source between the first position and the second position.

8. The sprayer of claim 7, wherein the signal is a waveform.

9. The sprayer of claim 2, wherein the waveform is one of a square wave, a step wave, and a sawtooth wave.

10. The sprayer of claim 1, further comprising a signal generator configured to produce an audio signal that moves the vibration source.

11. The sprayer of claim 10, wherein the audio signal is music.

12. A sprayer comprising:

a housing having a hollow body extending from an inlet end to an outlet end;

a fluid carrier disposed in the hollow body of the housing and having an inlet which extends through the inlet end and is configured to receive water, and an outlet for emitting water through the outlet end;

a vibration source disposed in the hollow body of the housing and operable in a first mode of operation, in which the water is emitted from the outlet having a first shape, and in a second mode of operation, in which the vibration source moves the fluid carrier such that the water is emitted from the outlet having a second shape that is different than the first shape; and a controller located in or on the housing and configured to switch the vibration source between the first and second modes of operation.

13. The sprayer of claim 12, further comprising:

a signal generator that produces a signal from input power; and an amplifier that receives the signal from the signal generator and outputs an amplified signal to the vibration source in the second mode of operation to oscillate the fluid carrier, wherein the controller includes a touch sensitive panel that controls operation of the signal generator and the amplifier through a user input.

14. The sprayer of claim 13, wherein each of the signal generator, the amplifier, and the controller is located in or on the housing.

15. The sprayer of claim 14, wherein the vibration source is operable in a third mode of operation, in which the water is emitted from the outlet having a third shape that is different than the first and second shapes, and the controller switches the vibration source between the first, second, and third modes of operation by a user input into the controller.

16. The sprayer of claim 13, wherein the amplified signal has a shape that is different than the second shape.

17. A sprayer comprising:

a hollow body having an inlet end with an inlet and an outlet end with an outlet, the inlet end being configured to detachably mount to a spout of a kitchen faucet;

a water supply tube that extends through the inlet into the hollow body and is moveable relative to the hollow body; and a vibration source located inside the hollow body and operable in a first mode of operation, in which the water supply tube does not move relative to the hollow body and water is dispensed from the outlet having a first shape, and a second mode of operation, in which the vibration source moves the water supply tube relative to the hollow body to dispense water from the outlet having a second shape that is different than the first shape.

18. The sprayer of claim 17, further comprising a signal generator that produces a signal, wherein the vibration source moves the water supply tube in response to the signal from the signal generator.

19. The sprayer of claim 18, wherein the signal produced by the signal generator is a variable signal that is adjustable by a controller to change the shape of the variable signal and the second shape.

20. A faucet comprising the spout, a base supporting the spout, the sprayer of claim 19 operatively coupled to the spout, and a handle configured to control water flow to the sprayer from a water supply, wherein the water supply tube extends through the spout and the base to fluidly connect with the water supply.

* * * * *